US007552927B2

(12) United States Patent
Moss

(10) Patent No.: US 7,552,927 B2
(45) Date of Patent: Jun. 30, 2009

(54) POKER-TYPE CARD GAME AND METHOD THEREFOR

(76) Inventor: David Moss, 7777 E. Main St., #264, Scottsdale, AZ (US) 85251

( * ) Notice: Subject to any disclaimer, the term of this patent is extended or adjusted under 35 U.S.C. 154(b) by 235 days.

(21) Appl. No.: 11/745,380

(22) Filed: May 7, 2007

(65) Prior Publication Data

US 2007/0262527 A1 Nov. 15, 2007

Related U.S. Application Data

(63) Continuation-in-part of application No. 11/015,921, filed on Dec. 20, 2004, now abandoned.

(51) Int. Cl.
*A63F 1/00* (2006.01)

(52) U.S. Cl. ..... 273/274; 273/292

(58) Field of Classification Search ..... 273/274, 273/292, 309; 463/12
See application file for complete search history.

(56) References Cited

U.S. PATENT DOCUMENTS 5,324,041 A * 6/1994 Boylan et al. ..... 273/292
5,544,892 A * 8/1996 Breeding ..... 273/292
5,799,945 A * 9/1998 Boylan et al. ..... 273/292
5,813,673 A * 9/1998 Richardson ..... 273/292
5,882,259 A * 3/1999 Holmes et al. ..... 463/13
6,102,402 A * 8/2000 Scott et al. ..... 273/292
6,406,024 B1 * 6/2002 Perkins ..... 273/292
6,474,644 B1 * 11/2002 Pickle et al. ..... 273/274
6,644,666 B1 * 11/2003 Tamura et al. ..... 273/292
6,986,514 B2 * 1/2006 Snow ..... 273/292
2004/0217548 A1 * 11/2004 Snow ..... 273/292

* cited by examiner

*Primary Examiner*—William M. Pierce
(74) *Attorney, Agent, or Firm*—Craig Weiss; Ryan Swank; Weiss & Moy, P.C.

(57) ABSTRACT

A poker-type game capable in which participants compete against a dealer in hands whose number of cards progressively increase. Play begins with two cards dealt to a dealer and two cards dealt to each player. Whoever has a superior two-card hand must place a wager into a transitional wagering area. At least three community cards are dealt creating first a three-card, then a four-card and ultimately a five-card poker hand. At each stage, whoever between the dealer and each at least one player has the inferior hand must place a wager equal to the ante wager into that player's transitional wagering area. Whoever has the best five-card poker hand collects all wagers placed in the transitional wagering area.

20 Claims, 1 Drawing Sheet

POKER-TYPE CARD GAME AND METHOD THEREFOR

CROSS-REFERENCE TO RELATED APPLICATIONS

This is a continuation-in-part of U.S. patent application Ser. No. 11/015,921 filed Dec. 20, 2004 now abandoned, in the name of the Applicant, to which priority is claimed.

FIELD OF THE INVENTION

This invention relates generally to card games and methods therefor and, more particularly, to a poker-type card game in which participants compete against a dealer in hands whose number of cards progressively increase.

BACKGROUND OF THE INVENTION

Poker is one of the most popular card games and continues to grow in popularity. Poker is usually played at a table against other players with a dealer employed by the casino. In standard poker, the dealer is not a participant, but merely deals the cards to the other players. Several versions of poker that involve multiple players playing against a dealer or the house, as opposed to each other, have been developed over the years. Games such as "Carribean Stud" (U.S. Pat. No. 4,836,553), "Double Down Stud" (U.S. Pat. No. 5,167,413), "Let It Ride" (U.S. Pat. No. 5,288,081) and "Three Card Poker" (U.S. Pat. No. 5,685,774) all involve multiple players against a dealer/the house.

While many of these games involve either standard five-card poker hands, or three cards (as in "Three Card Poker"), a need existed for a poker game that allows players to compete against a dealer in two-card, three-card, four-card and standard five-card hands all within a single hand against a dealer.

SUMMARY OF THE INVENTION

An object of the present invention is to provide a new poker-type card game and method therefor in which players compete against a dealer in a hand whose number of cards builds progressively.

BRIEF DESCRIPTION OF THE PREFERRED EMBODIMENTS

In accordance with one embodiment of the present invention, a method of playing a poker-type card game is disclosed, comprising, in combination the steps of receiving an ante wager from at least one player, dealing two cards to each at least one player, dealing two cards to a dealer, comparing a poker hand value of the two-card dealer hand with a poker hand value of each at least one two-card player hand, selecting as a superior hand whichever of the two-card dealer hand and each at least one two-card player hand having a higher poker value, assigning the ante wager of each at least one player to a transitional wagering area when the dealer having a superior two-card hand, the dealer placing in the transitional wagering area an amount equal to the ante wager of the at least one player when the at least one player having a superior two-card hand, permitting each at least one player to forfeit any wagers in the transitional wagering area and terminate their play, permitting each at least one player to place a second wager equal to the ante wager in order to continue their play, dealing a first community card, revealing the first community card, comparing a poker hand value of the three-card dealer hand comprised of a combination of the two-card dealer hand and the first community card with a poker hand value of each at least one three-card player hand comprised of a combination of the two-card player hand and the first community card, selecting as a superior hand whichever of the three-card dealer hand and each at least one three-card player hand having a higher poker value, assigning the second wager of each at least one player to the transitional wagering area when the dealer having a superior three-card hand, the dealer placing in the transitional wagering area an amount equal to the second wager of the at least one player when the at least one player having a superior three-card hand, permitting each at least one player to forfeit any wagers in the transitional wagering area and terminate their play, permitting each at least one player to place a third wager equal to one of the ante wager and the second wager in order to continue their play, dealing a second community card, revealing the second community card, comparing a poker hand value of the four-card dealer hand comprised of a combination of the two-card dealer hand and the first community card and the second community card with a poker hand value of each at least one four-card player hand comprised of a combination of the two-card player hand and the first community card and the second community card, selecting as a superior hand whichever of the four-card dealer hand and each at least one four-card player hand having a higher poker value, assigning the third wager of each at least one player to the transitional wagering area when the dealer having a superior four-card hand, the dealer placing in the transitional wagering area an amount equal to the third wager of the at least one player when the at least one player having a superior four-card hand, permitting each at least one player to forfeit any wagers in the transitional wagering area and terminate their play, permitting each at least one player to place a fourth wager equal to one of the ante wager and the second wager and the third wager in order to continue their play, dealing a third community card, revealing the third community card, comparing a poker hand value of the five-card dealer hand comprised of a combination of the two-card dealer hand and the first community card and the second community card and the third community card with a poker hand value of each at least one five-card player hand comprised of a combination of the two-card player hand and the first community card and the second community card and the third community card, selecting as a winning hand whichever of the five-card dealer hand and each at least one five-card player hand having a higher poker value, collecting the fourth wager and all other wagers placed in the transitional wagering area of each at least one player when the dealer having a winning five-card hand, and the dealer paying an amount equal to the fourth wager and all other wagers placed in the transitional wagering area of each at least one player when the at least one player having a winning five-card hand.

In accordance with another embodiment of the present invention, a method of playing a poker-type card game is disclosed, comprising, in combination the steps of dealing two cards to each at least one player, dealing two cards to a dealer, comparing a poker hand value of the two-card dealer hand with a poker hand value of each at least one two-card player hand, selecting as a superior hand whichever of the two-card dealer hand and each at least one two-card player hand having a higher poker value, assigning the ante wager of each at least one player to a transitional wagering area when the dealer having a superior two-card hand, the dealer placing in the transitional wagering area an amount equal to the ante wager of the at least one player when the at least one player having a superior two-card hand, permitting each at least one player to forfeit any wagers in the transitional wagering area and terminate their play, permitting each at least one player to place a second wager equal to the ante wager in order to continue their play, dealing at least three community cards, comparing a poker hand value of the five-card dealer hand comprised of a combination of the two-card dealer hand and the at least three community cards with a poker hand value of each at least one five-card player hand comprised of a combination of the two-card player hand and the at least three community cards, selecting as a winning hand whichever of the five-card dealer hand and each at least one five-card player hand having a higher poker value, collecting the second wager and all other wagers placed in the transitional wagering area of each at least one player when the dealer having a winning five-card hand, and the dealer paying an amount equal to the second wager and all other wagers placed in the transitional wagering area of each at least one player when the at least one player having a winning five-card hand.

DETAILED DESCRIPTION OF PREFERRED EMBODIMENT

Figure 1:
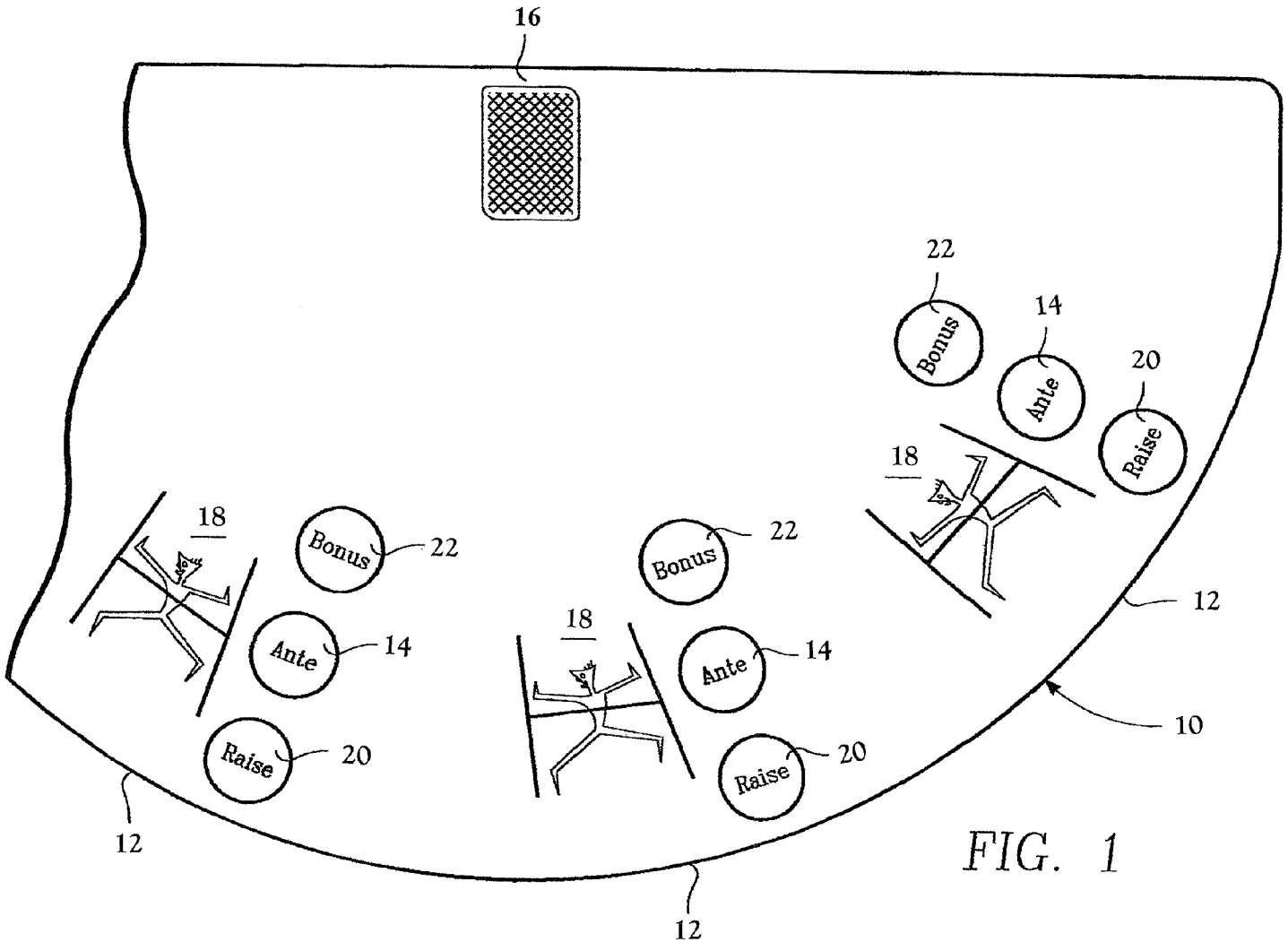
FIG. 1 is a top view of a table top upon which the preferred embodiment of the poker-type card game of the present invention is played.

The present invention includes a method of playing a poker-type card game. In the preferred embodiment, a game of stud poker is played, and the dealer is a casino dealer that represents the house or casino, however, it should be clearly understood that substantial benefit could be derived from an alternative embodiment of the present invention in which a game other than stud poker is played and/or in which the dealer is not a casino dealer.

Referring now to FIG. 1, the poker-type card game of the present invention is preferably played on a semicircular table top 10, similar in size and dimension to a standard blackjack casino table, although it should be clearly understood that substantial benefit could be derived from an alternative embodiment of the present invention in which the poker-type card game of the present invention is played at a different table (such as a standard oblong poker table) or on a video screen.

Still referring to FIG. 1, each player preferably has his/her own wagering station 12 (if played on a video screen such station may be represented graphically or not exist at all). Play is initiated when at least one player posts an ante wager that is collected by the dealer or house. This ante wager is preferably placed in a designated ante wagering area 14, although substantial benefit could be derived from an alternative embodiment of the present invention in which the ante wager is posted in some other way or in some other location, so long as it is posted. After the ante wager is posted by at least one player, the dealer preferably deals two cards to each player and two cards to the dealer. In one embodiment, the two cards dealt to each player are dealt face up, while the two cards dealt to the dealer are initially dealt face down prior to being revealed so as to increase anticipation and player excitement, although substantial benefit could be derived from an alternative embodiment of the present invention in which all cards are dealt face up. The dealer preferably deals two cards to a dealer area 16, although it should be clear that this could be represented graphically or otherwise communicated to each of the players.

After the two-card dealer hand is revealed, a poker hand value of the two-card dealer hand is compared to a poker and value of each of the two-card player hands. The standard poker hierarchy is applied wherein: a pair is superior to a non-pair, a higher pair is superior to a lower pair, a higher high card in a non-paired hand is superior to a lower high card in a non-paired hand, a higher low card in a non-paired hand is superior to a lower low card in a non-paired hand when both hands have an identical high card, and in which a tie is established between a dealer hand at least one player hand having identical pairs or identical non-paired hands.

If the dealer two-card hand is identified as a superior poker hand to at least one of the two-card player hands, then the ante wager of that player is assigned to a transitional wagering area 18. If the dealer two-card hand is identified as inferior in poker value to at least one of the two-card player hands, then the dealer places an amount equal to that player's ante wager into that player's transitional wagering area 18. In the event of a tie, in one embodiment of the present invention no wager is placed in the transitional wagering area 18, while in another embodiment play is terminated and the player's ante wager is returned.

Still referring to FIG. 1, in the preferred embodiment, each at least one player is permitted to forfeit his or her ante wager and terminate play after the two-card dealer hand and two-card player hands have been dealt, although substantial benefit could be derived from an alternative embodiment of the present invention in which players may not be permitted to terminate play. For example, it may be preferable to only give a player a right to terminate play if his or her hand is inferior to a dealer hand. If a player wishes to continue play, a player must preferably place a second wager into a "raise" or additional wager wagering area 20, although substantial benefit could be derived from an alternative embodiment of the present invention in which a player places the additional wager into the same ante wagering area 14 where the player previously posted his or her ante.

At least three community cards are dealt, preferably face down. In one embodiment, these community cards are revealed simultaneously resulting in a showdown between the dealer's five-card poker hand (comprising the dealer's initial two-card hand and the three community cards) and each player's five-card poker hand (comprising each player's initial two-card hand and the three community cards). If the dealer's hand is determined to have the higher poker value, then the dealer collects all wagers posted by the player along with any wager posted by the dealer into that player's transitional wagering area 18. If the player's hand is determined to have a higher poker value than the dealer's hand, then the dealer pays that player an amount equal to the wagers posted by the player along with any wagers placed by the dealer into that player's transitional wagering area 18.

In the preferred embodiment, however, the three community cards are revealed one at time, with an identical betting format occurring with each revealed community card. For example, if the player posts the second wager in order to see the first community card, then after that card is revealed each player's three-card hand (the player's initial two-card hand plus the first revealed community card) is compared to the dealer's three-card hand (the dealer's initial two-card hand plus the first revealed community card). If the dealer's three-card hand is superior to a player's then that player's additional wager is moved into that player's transitional wagering area 18. If, on the other hand, a player's three-card hand has a superior poker value to the dealer's three-card hand, then the dealer posts an amount equal to that player's wager into that player's transitional wagering area 18. Once again, each player preferably has the opportunity to terminate play and forfeit all wagers in the transitional wagering area 18. In the preferred embodiment, a player terminating play will receive back their initial ante wager as well as any additional wagers, but will forfeit all wagers located in the transitional wagering area 18. It should be clearly understood, however, that substantial benefit could be derived from an alternative embodiment of the present invention in which a player forfeits all wagers made, including the ante wager, or in which the player forfeits all wagers excluding the ante wager.

This process is then repeated once the second community card is revealed and a comparison is made between the dealer's four-card poker hand and each player's four card poker hand. Preferably, the standard poker hierarchy is applied, wherein a four-card hand beats a three-card hand, and no four-card straights or flushes count, although substantial benefit could be derived from an alternative poker hierarchy in which three-card or four-card straights and flushes are valued.

In the preferred embodiment, the third community card is revealed which allows for the creation of a dealer five-card poker hand and player five-card poker hands. If the player's five-card poker hand is determined to be better than the dealer's five-card poker hand then that player collects all wagers, including those placed in the transitional wagering area 18. If the dealer's five card poker hand is the winning hand, then the dealer collects that player's wagers, including those in that player's transitional wagering area 18.

In the preferred embodiment, a player having a winning five-card poker hand must pay a five percent commission on all wagers paid by the dealer. While, in the preferred embodiment the winning player must pay a five percent commission on all wagers paid by the dealer, it should be clearly understood that substantial benefit could be derived from an alternative embodiment of the present invention in which no commission is paid, or in which a smaller or larger commission is paid. For example, in lieu of a commission, a minimum qualifying hand may be established by which a player is only entitled to wagers placed by the dealer if the dealer's hand meets a pre-determined poker value.

In the preferred embodiment, each player is permitted to become eligible to receive a bonus payout in the event that that player receives a hand having a pre-determined poker value. It is preferably necessary to place a separate wager to qualify for this bonus payout, although substantial benefit could be derived from an alternative embodiment of the present invention in which there is no bonus payout or in which no wager is necessary for a player to qualify for the bonus payout.

In the preferred embodiment, each player is permitted to become eligible to receive a bad beat payout in the event that that player receives a losing hand having a pre-determined poker value. It is preferably necessary that a player need not wager to qualify for this bad beat payout, although substantial benefit could be derived from an alternative embodiment of the present invention in which there is no bad beat payout or in which a player must place a separate wager in order to qualify for the bad beat payout.

What is claimed is:

1. A method of playing a poker-type card game comprising, in combination, the steps of:

receiving an ante wager from at least one player;

dealing two cards to each said at least one player;

dealing two cards to a dealer;

comparing a poker hand value of the two-card dealer hand with a poker hand value of each at least one two-card player hand;

selecting as a superior hand whichever of said two-card dealer hand and each said at least one two-card player hand having a higher poker value;

assigning said ante wager of each said at least one player to a transitional wagering area when said dealer having a superior two-card hand;

said dealer placing in said transitional wagering area an amount equal to said ante wager of said at least one player when said at least one player having a superior two-card hand;

permitting each said at least one player to forfeit any wagers in said transitional wagering area and terminate their play;

permitting each said at least one player to place a second wager equal to said ante wager in order to continue their play;

dealing a first community card;

revealing said first community card;

comparing a poker hand value of the three-card dealer hand comprised of a combination of the two-card dealer hand and said first community card with a poker hand value of each at least one three-card player hand comprised of a combination of the two-card player hand and said first community card;

selecting as a superior hand whichever of said three-card dealer hand and each said at least one three-card player hand having a higher poker value;

assigning said second wager of each said at least one player to said transitional wagering area when said dealer having a superior three-card hand;

said dealer placing in said transitional wagering area an amount equal to said second wager of said at least one player when said at least one player having a superior three-card hand;

permitting each said at least one player to forfeit any wagers in said transitional wagering area and terminate their play;

permitting each said at least one player to place a third wager equal to one of said ante wager and said second wager in order to continue their play;

dealing a second community card;

revealing said second community card;

comparing a poker hand value of the four-card dealer hand comprised of a combination of the two-card dealer hand and said first community card and said second community card with a poker hand value of each at least one four-card player hand comprised of a combination of the two-card player hand and said first community card and said second community card;

selecting as a superior hand whichever of said four-card dealer hand and each said at least one four-card player hand having a higher poker value;

assigning said third wager of each said at least one player to said transitional wagering area when said dealer having a superior four-card hand;

said dealer placing in said transitional wagering area an amount equal to said third wager of said at least one player when said at least one player having a superior four-card hand;

permitting each said at least one player to forfeit any wagers in said transitional wagering area and terminate their play;

permitting each said at least one player to place a fourth wager equal to one of said ante wager and said second wager and said third wager in order to continue their play;

dealing a third community card;

revealing said third community card;

comparing a poker hand value of the five-card dealer hand comprised of a combination of the two-card dealer hand and said first community card and said second community card and said third community card with a poker hand value of each at least one five-card player hand comprised of a combination of the two-card player hand and said first community card and said second community card and said third community card;

selecting as a winning hand whichever of said five-card dealer hand and each said at least one five-card player hand having a higher poker value;

collecting said fourth wager and all other wagers placed in said transitional wagering area of each said at least one player when said dealer having a winning five-card hand; and said dealer paying an amount equal to said fourth wager and all other wagers placed in said transitional wagering area of each said at least one player when said at least one player having a winning five-card hand.

2. The method of claim 1 wherein said poker value of two-card and three-card and four-card and five-card poker hands being determined by standard poker hand hierarchy and wherein hands of identical poker value being a tie resulting in no wager assignment to said transitional wagering area.

3. The method of claim 1 wherein said ante wager being received by six players playing around a table substantially similar in size to a standard blackjack table.

4. The method of claim 1 further comprising the steps of:

dealing two cards to each at least one player face up;

dealing two cards to said dealer face down; and revealing said two cards dealt to said dealer after each said at least one player having been dealt their two cards.

5. The method of claim 1 wherein said first community card and said second community card and said third community card being dealt at the same time face down prior to being individually revealed.

6. The method of claim 1 further comprising the step of collecting from each said at least one player having a winning five-card hand a commission on wagers paid by said dealer.

7. The method of claim 6 wherein said commission being five percent of a total amount of wagers paid by said dealer.

8. The method of claim 1 further comprising the step of permitting said at least one player to become eligible to receive a bonus payout in the event that said at least one player receives a hand having a pre-determined poker value.

9. The method of claim 8 further comprising the step of collecting a bonus wager from said at least one wager in order to qualify for said bonus payout.

10. The method of claim 1 further comprising the step of permitting said at least one player to become eligible to receive a bad beat payout in the event that said at least one player receives a losing hand having a pre-determined poker value.

11. A method of playing a poker-type card game comprising, in combination, the steps of:

receiving an ante wager from at least one player;

dealing two cards to each said at least one player;

dealing two cards to a dealer;

comparing a poker hand value of the two-card dealer hand with a poker hand value of each at least one two-card player hand;

selecting as a superior hand whichever of said two-card dealer hand and each said at least one two-card player hand having a higher poker value;

assigning said ante wager of each said at least one player to a transitional wagering area when said dealer having a superior two-card hand;

said dealer placing in said transitional wagering area an amount equal to said ante wager of said at least one player when said at least one player having a superior two-card hand;

permitting each said at least one player to forfeit any wagers in said transitional wagering area and terminate their play;

permitting each said at least one player to place a second wager equal to said ante wager in order to continue their play;

dealing at least three community cards;

comparing a poker hand value of the five-card dealer hand comprised of a combination of the two-card dealer hand and said at least three community cards with a poker hand value of each at least one five-card player hand comprised of a combination of the two-card player hand and said at least three community cards;

selecting as a winning hand whichever of said five-card dealer hand and each said at least one five-card player hand having a higher poker value;

collecting said second wager and all other wagers placed in said transitional wagering area of each said at least one player when said dealer having a winning five-card hand; and said dealer paying an amount equal to said second wager and all other wagers placed in said transitional wagering area of each said at least one player when said at least one player having a winning five-card hand.

12. The method of claim 11 wherein said poker value of two-card and five-card poker hands being determined by standard poker hand hierarchy and wherein hands of identical poker value being a tie resulting in no wager assignment to said transitional wagering area.

13. The method of claim 11 wherein said ante wager being received by six players playing around a table substantially similar in size to a standard blackjack table.

14. The method of claim 11 further comprising the steps of:

dealing two cards to each at least one player face up;

dealing two cards to said dealer face down; and revealing said two cards dealt to said dealer after each said at least one player having been dealt their two cards.

15. The method of claim 11 further comprising the steps of:

dealing said at least three community cards face down;

revealing a first community card;

comparing a poker hand value of the three-card dealer hand comprised of a combination of the two-card dealer hand and said first community card with a poker hand value of each at least one three-card player hand comprised of a combination of the two-card player hand and said first community card;

selecting as a superior hand whichever of said three-card dealer hand and each said at least one three-card player hand having a higher poker value;

assigning said second wager of each said at least one player to said transitional wagering area when said dealer having a superior three-card hand;

said dealer placing in said transitional wagering area an amount equal to said second wager of said at least one player when said at least one player having a superior three-card hand;

permitting each said at least one player to forfeit said ante wager and said second wager and terminate their play;

permitting each said at least one player to place a third wager equal to one of said ante wager and said second wager in order to continue their play;

revealing a second community card;

comparing a poker hand value of the four-card dealer hand comprised of a combination of the two-card dealer hand and said first community card and said second community card with a poker hand value of each at least one four-card player hand comprised of a combination of the two-card player hand and said first community card and said second community card;

selecting as a superior hand whichever of said four-card dealer hand and each said at least one four-card player hand having a higher poker value;

assigning said third wager of each said at least one player to said transitional wagering area when said dealer having a superior four-card hand;

said dealer placing in said transitional wagering area an amount equal to said third wager of said at least one player when said at least one player having a superior four-card hand;

permitting each said at least one player to forfeit said ante wager and said second wager and said third wager and terminate their play;

permitting each said at least one player to place a fourth wager equal to one of said ante wager and said second wager and said third wager in order to continue their play;

revealing a third community card;

comparing a poker hand value of the five-card dealer hand comprised of a combination of the two-card dealer hand and said first community card and said second community card and said third community card with a poker hand value of each at least one five-card player hand comprised of a combination of the two-card player hand and said first community card and said second community card and said third community card;

selecting as a winning hand whichever of said five-card dealer hand and each said at least one five-card player hand having a higher poker value;

collecting said fourth wager and all other wagers placed in said transitional wagering area of each said at least one player when said dealer having a winning five-card hand; and said dealer paying an amount equal to said fourth wager and all other wagers placed in said transitional wagering area of each said at least one player when said at least one player having a winning five-card hand.

16. The method of claim 11 further comprising the step of collecting from each said at least one player having a winning five-card hand a commission on wagers paid by said dealer.

17. The method of claim 16 wherein said commission being five percent of a total amount of wagers paid by said dealer.

18. The method of claim 11 further comprising the step of permitting said at least one player to become eligible to receive a bonus payout in the event that said at least one player receives a hand having a pre-determined poker value.

19. The method of claim 18 further comprising the step of collecting a bonus wager from said at least one wager in order to qualify for said bonus payout.

20. The method of claim 11 further comprising the step of permitting said at least one player to become eligible to receive a bad beat payout in the event that said at least one player receives a losing hand having a pre-determined poker value.

* * * * *